US005443012A

United States Patent [19]

Underbrink et al.

[11] Patent Number: 5,443,012

[45] Date of Patent: Aug. 22, 1995

[54] PLAYGROUND CARRIAGE

[75] Inventors: John M. Underbrink, Olympia; Russell L. Keeler, Seattle, both of Wash.

[73] Assignee: BigToys, Inc., Olympia, Wash.

[21] Appl. No.: 209,952

[22] Filed: Mar. 11, 1994

[51] Int. Cl.[6] ..... A63G 1/00; B61B 9/00; B61B 12/02

[52] U.S. Cl. ..... 104/53; 104/118; 104/166; 104/243; 104/249; 472/27

[58] Field of Search ..... 104/53, 67, 118, 163, 104/166, 169, 180, 188, 243, 249, 254; 482/35, 37, 51; 472/27; 198/321, 750

[56] References Cited

U.S. PATENT DOCUMENTS

| | | | |
|---|---|---|---|
| 188,611 | 3/1877 | Dutrow | 104/243 |
| 402,933 | 5/1889 | Judson . | |
| 2,241,399 | 5/1941 | Harris | 104/166 X |
| 3,057,305 | 10/1962 | Behrens | 104/53 X |
| 3,164,104 | 1/1965 | Hunt | 104/166 |
| 3,604,362 | 9/1971 | Goirand | 104/166 |
| 3,850,280 | 11/1974 | Ohrnell | 198/1 |
| 3,897,735 | 8/1975 | Watts | 104/166 |
| 3,969,871 | 7/1976 | Ewers | 482/35 X |
| 4,203,511 | 5/1980 | Uhing | 198/458 |
| 5,154,275 | 10/1992 | Speckhart et al. | 198/416 |
| 5,156,507 | 10/1992 | Underbrink | 411/63 |

FOREIGN PATENT DOCUMENTS

| | | | |
|---|---|---|---|
| 714323 | 7/1965 | Canada . | |
| 441388 | 2/1992 | Japan | 198/321 |
| 1033823 | 6/1966 | United Kingdom . | |

*Primary Examiner*—Robert J. Oberleitner

*Assistant Examiner*—Kevin D. Rutherford

*Attorney, Agent, or Firm*—Christensen, O'Connor, Johnson & Kindness

[57] ABSTRACT

In accordance with the present invention, a playground carriage (10) is provided for moving people (100) from one play area to another. The playground carriage comprises a rotatable support pipe (12) having a first end (14) and a second end (16). The support pipe extends between a first vertical column (18) and a second vertical column (20). A manually-operated crank (22) having a first end (24) and a second end (26) is also included. The manually-operated crank extends between the first vertical column and a third vertical column (48). The first end of the crank is coupled to the first end of the support pipe so that manually turning the crank rotates the support pipe. A carriage (28) for carrying people is mounted to the support pipe. The carriage is advanced along the support pipe by a carrier (30). The carrier comprises a set of wheels (31) oriented along an outer surface (34) of the support pipe so that the wheels follow a helical, thread-like path along the support pipe and, thus, propel the carrier along the support pipe. A plurality of handrails (36) extend downwardly from the carrier and attach to a platform (37) so that the platform is suspended below the carrier. A protective housing (88) encapsulates the carrier. A guide rail (43) is located immediately below the platform of the carriage and extends parallel to the support pipe between the first vertical column and the second vertical column. In addition, a guide (38) is attached to a lower surface (35) of the platform and engages the guide rail in order to prevent the carriage from swinging excessively as it moves along the support pipe.

31 Claims, 7 Drawing Sheets

PLAYGROUND CARRIAGE

FIELD OF THE INVENTION

This invention generally relates to playground and recreational equipment, and, more specifically, to a playground carriage used to move people along a path from one play area to another.

BACKGROUND OF THE INVENTION

Large, sturdy, and creative toys for use in playgrounds, parks, and similar recreational environments come in a multitude of shapes, sizes, and configurations. New and innovative playground toys and structures that safely entertain children and others are difficult to design. A play structure must be creative enough to capture a user's imagination (normally a child's imagination) and maintain his or her attention while still providing a high degree of safety. In addition, the play structure must withstand the rigors of the outdoors and constant use by children. Consequently, many playground structures are large, relatively stationary, wood and metal structures upon which children and others climb, swing and amuse themselves without serious threat of injury to themselves or damage to the structure. An example of such a play structure is a playground gym made of logs that includes fairly simple features such as a slides, tire ladders and swings. Playground equipment that involves more complex, interacting mechanical features, such as gears, wheels and carriages, are less common. Such play structures require a higher level of concerted human effort for operation. With the emphasis that the educational and health communities have recently placed on the need to promote physical fitness, communication and social interaction between persons at an early age, the demand for such innovative and complex playground equipment has increased. Accordingly, the present invention enables a person in a remote location to perform a physical function that inspires the users to communicate with each other more easily, to interact socially, and to exert themselves physically.

The present invention is a playground carriage that is designed to move people safely from one play area to another. A carriage loaded with people is propelled linearly along the length of a support pipe. The support pipe has a turning crank on at least one end that rotates the pipe as it is manually turned. The carriage is propelled along the rotating support pipe by a set of carriage wheels that are oriented at an angle to the face of the pipe so that they follow a helical or thread-like path along the pipe.

Devices for moving objects along a rotatable pipe that include an arrangement of wheels oriented at an angle to the surface of the pipe, such that rotating movement of the pipe is translated into longitudinal movement of the device, have already been disclosed in the prior art, e.g., U.S. Pat. No. 4,203,511. However, in the prior art these devices have been used only in conjunction with motorized cranking mechanisms. Motorized or electro-mechanical cranking mechanisms are not practical in a playground or recreational environment from the standpoints of both safety and cost. On the other hand, manual cranking mechanisms as employed by the present invention are safer and more cost efficient. More importantly, the manual cranking mechanism of the present invention requires human effort for operation, as well as encouraging communication, social interaction and physical exertion among the users.

Finally, the devices disclosed in the prior art must be made inaccessible to persons in a playground or recreational environment in order to prevent injury. Such protective measures are not contemplated in the prior art. In the present invention, however, the carriage wheels are covered by a protective housing so that they are inaccessible to users.

In sum, the present invention provides a creative, exciting, yet safe, play structure for transporting people, wherein a person must manually turn a crank to propel a carriage carrying others from one play area to another. The present invention requires that the users cooperate in order to successfully propel themselves along the pipe. Thus, the present invention promotes communication, social interaction and physical exercise.

SUMMARY OF THE INVENTION

The present invention provides an apparatus for use in playground and recreational environments that is adapted to move from one area to another. The present invention includes a support pipe rotatable along its longitudinal axis, a first end of the support pipe braced by a first vertical column and a second end of the support pipe braced by a second vertical column, wherein the support pipe extends between the first vertical column and the second vertical column. A manually-operated crank is also provided having a first end and a second end, wherein the first end of the crank is coupled to the first end of the support pipe so that manually turning the crank rotates the pipe.

The present invention further comprises a carriage mounted upon the pipe. The carriage comprises a carrier containing a set of wheels oriented along an outer surface of the pipe so that the set of wheels follows a helical, thread-like path along the pipe and, thus, propels the carriage along the longitudinal axis of the pipe as the pipe is rotated. In a preferred embodiment, a plurality of handrails extend downwardly from the carrier, and a platform is attached to the handrails so that the platform is suspended below the carrier. A protective housing encapsulates the carrier containing the set of wheels.

A preferred embodiment of the present invention also comprises a guide rail adapted to guide the carriage. The guide rail is located immediately below the platform of the carriage and extends parallel to the support pipe between the first vertical column and the second vertical column. In addition, a guide attached to a lower surface of the platform engages the guide rail and prevents the carriage from swinging excessively as it moves along the pipe.

Other embodiments of the present invention include a receiving deck adjacent the second vertical column and upon which people transported by the carriage may dismount, and a cranking deck adjacent the first vertical column and upon which people manually turning the crank may be positioned.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

Detailed Description of the Preferred Embodiment

Figure 1:
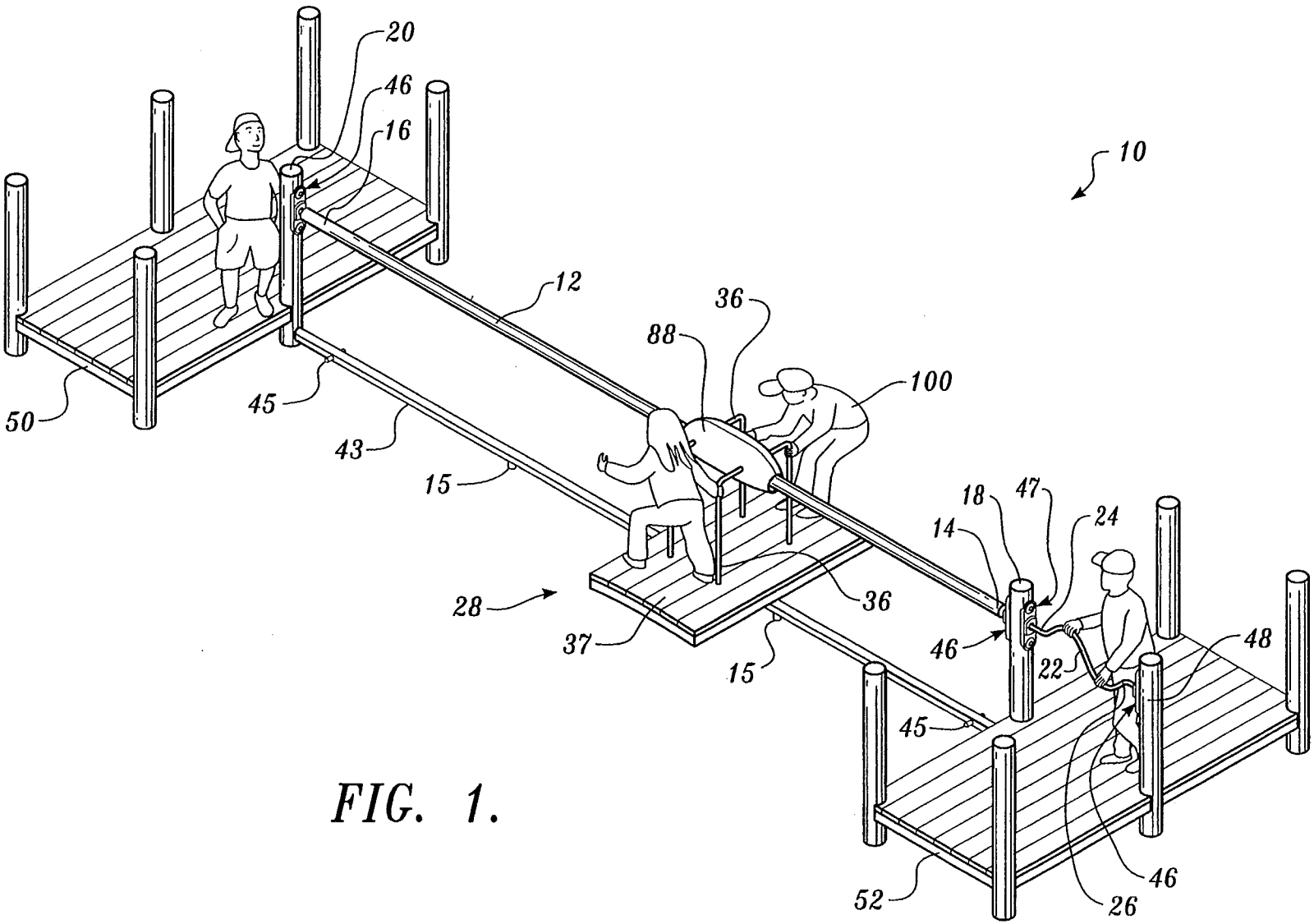
FIG. 1 is a three-dimensional view of a preferred embodiment of the present invention being used by a group of children on a playground.

A three-dimensional view of a preferred embodiment of the present invention is shown in FIG. 1. In the illustrated embodiment, a playground carriage 10 is shown being used by a group of people 100. The playground carriage 10 includes a support pipe 12 having a first end 14 and a second end 16. The pipe 12 extends between a first vertical column 18 and a second vertical column 20. A manually-operated crank 22 having a first end 24 and a second end 26 extends between the first vertical column 18 and a third vertical column 48. The first end 24 of the crank 22 is attached to the first end 14 of the pipe 12 so that the pipe is rotated about its longitudinal axis when a person manually turns the crank. In addition, the crank may be turned in one or the opposite direction. Therefore, the pipe is rotatable in one or the opposite direction as well.

Figure 2:
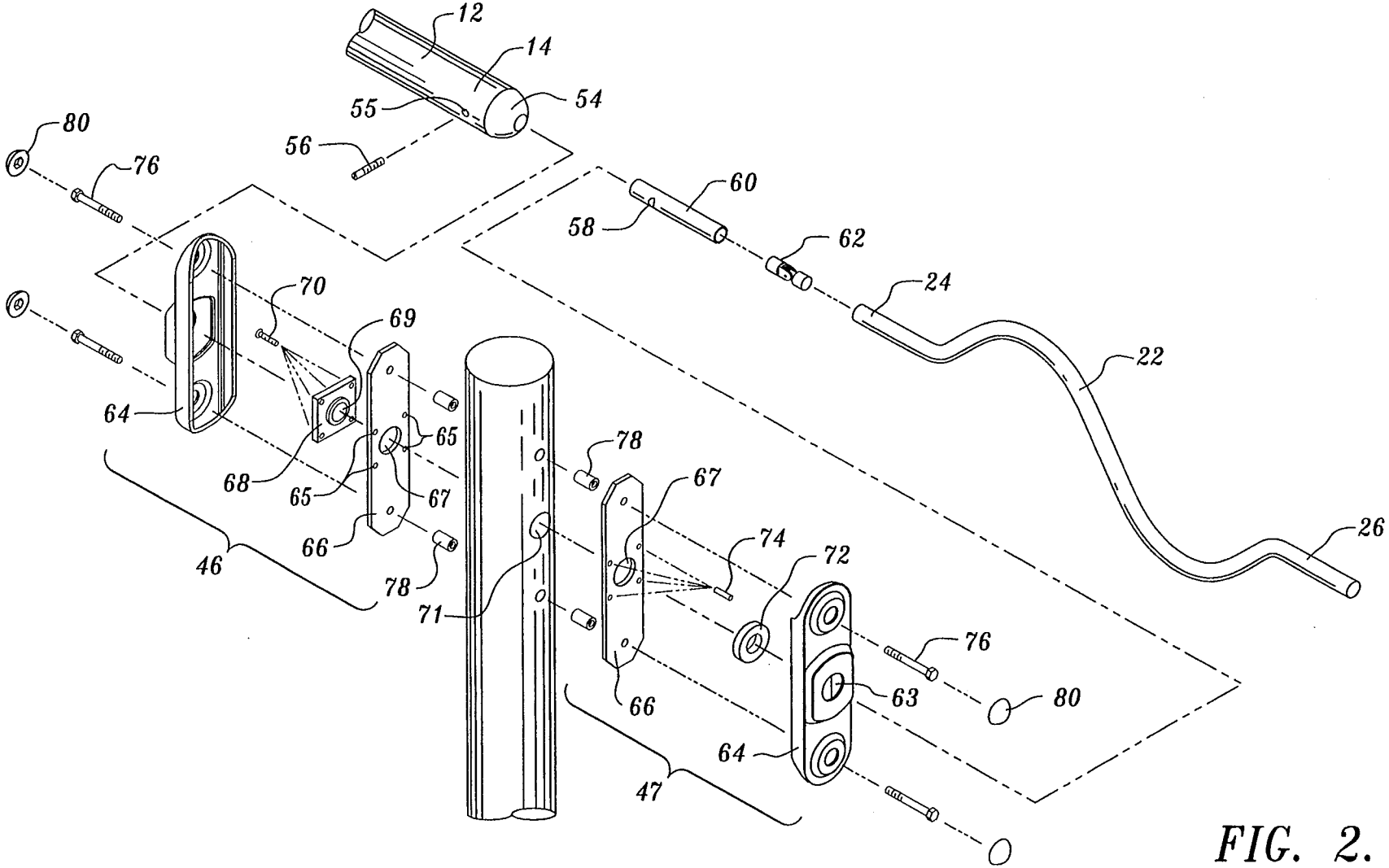
FIG. 2 is an exploded three-dimensional view of a crank, bearing, vertical column and support pipe assembly formed in accordance with the present invention.
Figure 3:
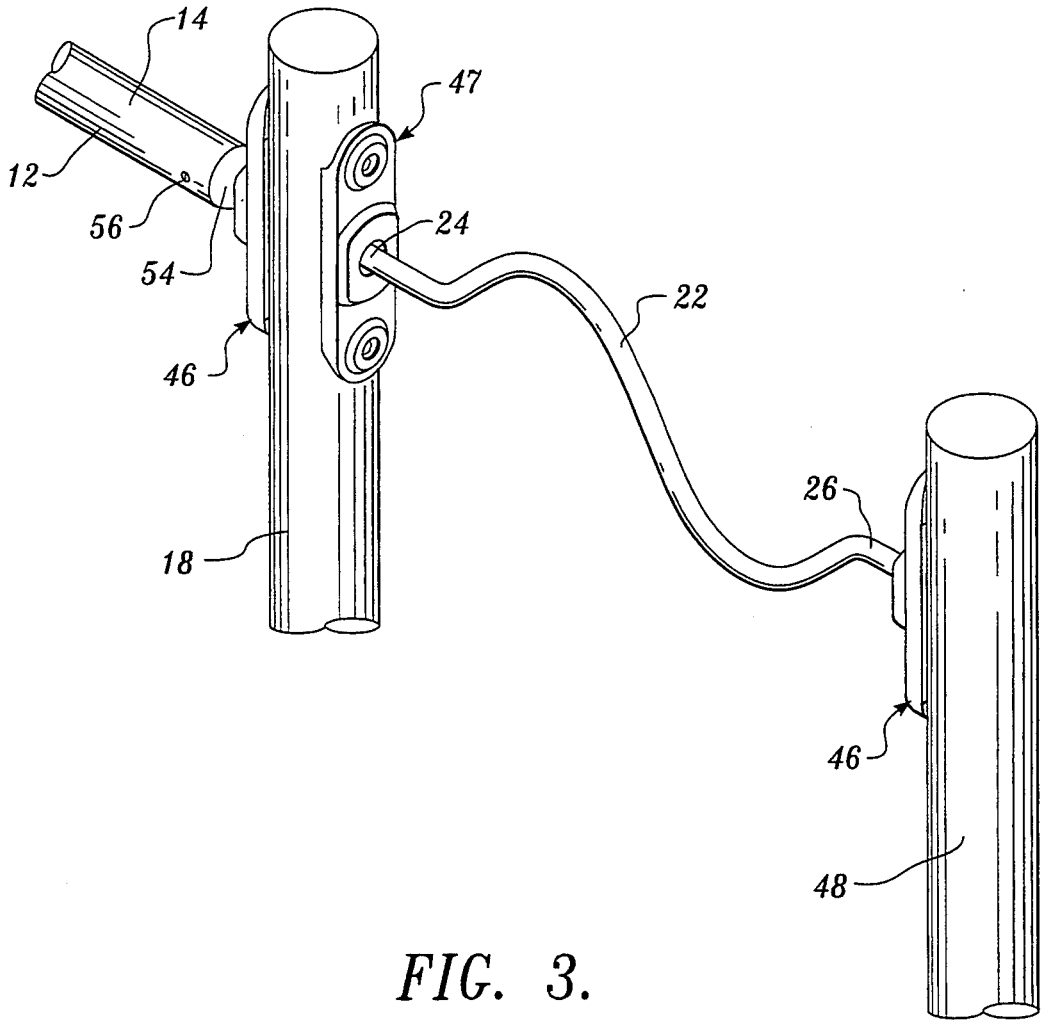
FIG. 3 is a three-dimensional view of the structure illustrated in FIG. 2 once assembled.

The playground carriage 10 is assembled so that the support pipe 12 and the manually-operated crank 22 are freely rotatable. As shown in more detail in FIGS. 2 and 3, the first end 14 of the pipe 12 is braced by a bearing assembly 46, which is mounted to one side of the first vertical column 18. The first end 24 of the crank is coupled to a ring assembly 47 mounted on the opposite side of the first vertical column. The ring assembly 47 is attached to the vertical column 18 is centered around a bore 71 which has been drilled through the first vertical column. The ring assembly comprises a bearing plate 66, an O-shaped ring 72 and a bearing cover 64. First, the rectangular bearing plate 66 containing a bearing plate hole 67 is mounted to the first vertical column so that the bearing plate hole 67 is in alignment with the bore 71. The bearing plate also contains four small screw holes 65 which surround the bearing plate hole 67. A roll pin 74 is placed within each small screw hole 65 so that the roll pin protrudes beyond the surface of the bearing plate 66 and away from the first vertical column. The O-shaped ring 72 is then placed adjacent to the bearing plate and within an area defined between the protruding roll pins 74. Finally, the bearing cover 64 is mounted upon the first vertical column 18 so that it encases the bearing plate 66 and the O-shaped ring 72. A pair of bolts 76 attach the bearing plate and the bearing cover to the first vertical column. Each bolt 76 is secured to a nut 78 which is mounted in the first vertical column. A hemispherical cap 80 is mounted to the head of each bolt 76 to protect persons from scraping themselves against the bolt. The bearing cover is mounted upon the first vertical column so that a bearing cover hole 63 contained in the bearing cover is aligned with the O-shaped ring 72, the bearing plate hole 67, and the bore 71 drilled through the first vertical column. However, the bearing cover hole 63 is slightly larger in diameter than bearing plate hole 67. The O-shaped ring is preferably made of an ultra-high molecular weight plastic or similar anti-friction material, which allows the O-shaped ring to float relatively freely between the bearing cover and the bearing plate, and within the area defined by the roll pins 74. The floating O-shaped ring prevents persons reaching through the slightly larger bearing cover hole 63 and pinching themselves within the ring assembly.

The construction of the bearing assembly 46 bracing the first end 14 of the pipe 12 mirrors that of the ring assembly 47, except the bearing assembly is attached to the opposite side of first vertical column 18. In addition, the bearing assembly also contains the bearing plate 66 and the bearing cover 64. However, the bearing assembly contains a bearing 68 as opposed to an O-shaped ring 72. The bearing 68 is square-shaped and includes a bearing hole 69 defined through its center. As for the construction of the bearing assembly, the bearing plate 66 containing the bearing plate hole 67 is mounted to the first vertical column 18 so that the bearing plate hole 67 is aligned with the bore 71 of the first vertical column. Next, the bearing 68 is mounted to the bearing plate 66 by a set of four screws 70, which pass through the small screw holes 65 in the bearing plate 66. The bearing 68 is mounted to the bearing plate 66 so that the bearing hole 69 is also in alignment with the bore 71 of the first vertical column. The bearing 68 is preferably made of an ultra-high molecular weight plastic or similar anti-friction material. The bearing cover 64 containing the bearing cover hole 63 is then mounted to first vertical column 18 so that it encases the bearing 68 and the bearing plate 66. In addition, the bearing cover hole 63 is aligned with the bearing hole 69, the bearing plate hole 67 and the bore 71 of the first vertical column, as well as the ring assembly 47 mounted on the opposite side of the vertical column 18. The diameter of the bearing cover hole 63 is slightly larger than the diameter of the bearing hole, therefore, a portion of the bearing 68 surrounding the bearing hole 69 protrudes through the bearing cover hole 63 so that persons are unable to pinch fingers within the bearing assembly 46. Again, the bearing cover 64 and the bearing plate 66 are secured to the first vertical column by a pair of bolts 76 and nuts 78. It must be noted, however, that the bearing cover 64 and the bearing plate 66 of both the bearing assembly 46 and ring assembly 37 may be mounted to the first vertical column by an expansible fastening device (not shown) which is disclosed in commonly assigned U.S. Pat. No. 5,156,507, the disclosure and drawings of which are specifically incorporated herein by reference.

Once the ring assembly 47 and the bearing assembly 46 have been mounted upon the first vertical column 18, the pipe 12 and the crank 22 must be attached. The first end 24 of the crank 22 is welded to a universal joint 62. The opposite end of the universal joint 62 is welded to a pipe stub 60. The pipe stub is long enough so that when inserted into the ring assembly 47, it passes through the ring assembly, the bore 71 of the first vertical column, and the bearing assembly 46. The outer diameter of the pipe stub is slightly smaller than the diameter of the bearing hole 69 and the O-shaped ring 72. Therefore, the pipe stub fits snugly therein. When fully inserted, the pipe stub protrudes through the bearing assembly mounted upon the opposite side of the first vertical column. Next, the pipe stub is inserted into a hemispherical casting 54 that is attached to the first end 14 of the pipe 12. A set screw 56 secures the pipe stub to the pipe through a hole 55 in the first end of the pipe and a hole 58 in the pipe stub. Once the pipe stub is fully inserted and attached to the pipe through the bearing assembly 46, the pipe is supported by the bearing assembly, while the universal joint 62 and the first end 24 of the crank 22 are housed within the bore 71 of the first vertical column and the ring assembly 47.

Referring primarily to FIG. 1, the second end 16 of the pipe 12, it is also coupled to another bearing assembly 46 mounted to the second vertical column 22 by a pipe stub 60, a casting 54, and a set screw 56 as described above. In operation, the pipe 12 is rotated by manually turning the crank 22. The bearing assemblies 46 at either end of the pipe both support the pipe and allow the pipe to rotate freely and easily. In particular, the bearings 68 which are made of an anti-friction material and are contained within the bearing assemblies 46, substantially eliminate friction and allow the pipe 12 to rotate freely. It will be obvious to one skilled in the art that any type of bearing and/or bearing assembly that can support the pipe and allow the pipe to freely rotate may be suitably used.

As the crank 22 is manually turned during operation, the pipe 12 rotates because the crank is connected to the pipe by the universal joint 62 and the pipe stub 60. The universal joint provides the crank with a degree of flexibility while it is being turned. Such flexibility is necessary to ensure proper alignment of the pipe in relation to the crank. If a universal joint is not present and the crank is connected directly to the pipe by the pipe stab 60, rotation of the crank may cause the pipe stub to twist, forcing the pipe and the crank out of alignment. As a result, the crank would become increasingly difficult to turn and would eventually bind up and stop turning completely. Another consequence of including the universal joint 62 is that a bearing is not necessary to facilitate free rotation of the first end 24 of the crank. In fact, a bearing would hamper free rotation because it would limit the flexibility of the universal joint. Consequently, the ring assembly 47 including the O-shaped ring 72, is used to couple the first end of the crank with the first vertical column 18 as opposed to a bearing assembly. The O-shaped ring floats relatively freely between the bearing plate 66 and the bearing cover 64 and allows the universal joint to remain flexible. In addition, the O-shaped ring fills any space between the first end of the crank and the ring assembly so that persons cannot pinch fingers and such between the crank and the bearing cover 64 of the ring assembly.

Yet another consequence of the universal joint 62 is that the crank 22 would be allowed to move relatively freely in all directions due to the flexibility of the universal joint if the second end of the crank were not braced in some way. In order to brace the crank, the second end 26 of the crank is coupled to a third vertical column 48 by another bearing assembly 46 so that the crank extends between the first vertical column 18 and the third vertical column 48. Here, the bearing assembly supports the crank and limits the movement of the crank to either a forward or backward rotation. Because the bearing 68 is made of a ultra-high molecular weight plastic or similar anti-friction material, the crank is allowed to turn freely and easily within the bearing assembly 46 mounted to the third vertical column 48. In addition, the bearing 68 on the third vertical column protrudes through the bearing cover hole 63 of the bearing cover 64, thus preventing persons from pinching themselves between the crank and the bearing assembly. It will be obvious to those skilled in the art that any type of crank that facilitates easy rotation may be used. In the preferred embodiment, the crank employed is known as a windlass.

Figure 4:
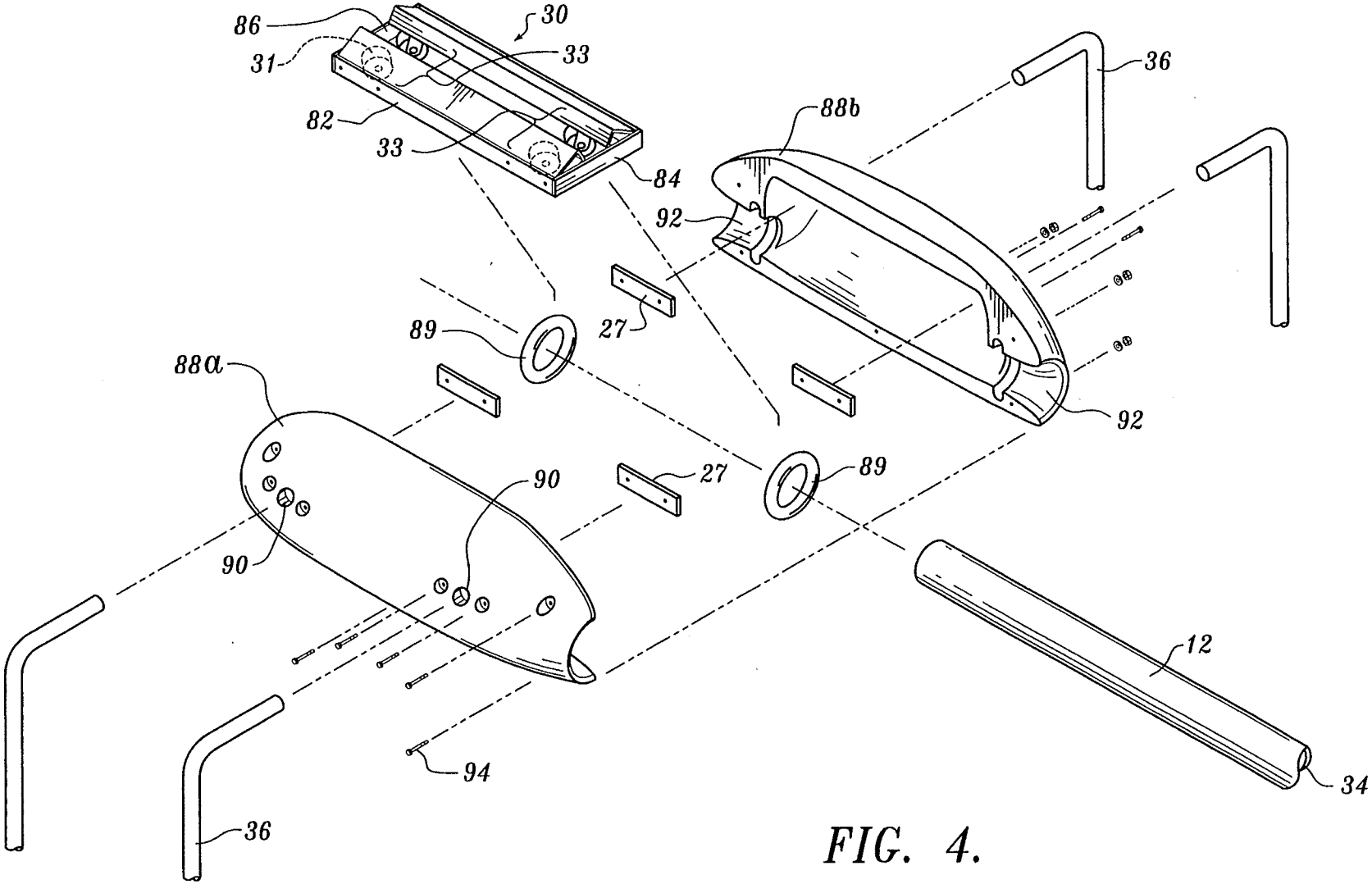
FIG. 4 is an exploded three-dimensional view of a carriage, carrier, support pipe, and protective housing assembly formed in accordance with the present invention.

The playground carriage further comprises a carriage 28 for carrying people that is mounted upon the pipe 12. As the pipe is rotated, the carriage 28 advances along the longitudinal axis of the pipe. As illustrated in FIG. 4, the carriage 28 is propelled by a carrier 30 that is adapted to advance the carriage along the pipe. In a preferred embodiment, the carrier 30 comprises a rectangular frame 82 having a length and a width. The frame 82 is preferably made of a very strong, rigid material such as galvanized steel. The frame has a first end 84 and an opposing second end 86. The carrier 30 is placed above the pipe so that the length of the frame runs parallel to the pipe. A set of wheels 31 is mounted on the underside of the frame 82. The wheels are preferably made of urethane plastic or similar material in order to reduce friction and increase durability. In the preferred embodiment, a first pair 32 of wheels is attached to the first end 84 of the frame, while a second pair 33 of wheels is attached to the second end 86 of the frame. Each wheel of both the first pair 32 and the second pair 33 are mounted to the frame 82 by a flange 96. The flange 96 comprises a pair of elongate tubes with a rectangular cross-section. When the carrier 30 is placed upon the pipe 12, both the first pair and the second pair of wheels are oriented so that the wheels frictionally engage a smooth cylindrical outer surface 34 of the pipe and follow a helical or thread-like path along the pipe as it is rotated.

Figure 6:
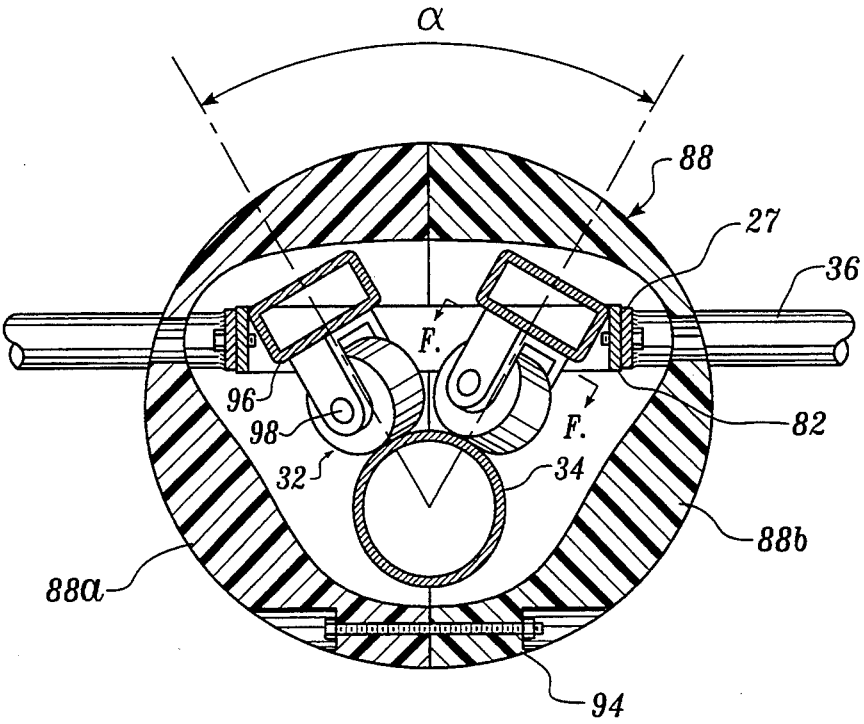
FIG. 6 is a cross-section of the carrier mounted upon the support pipe of FIG. 5.

FIG. 6 is a cross-section of the carrier 30 mounted upon the support pipe 12. This figure illustrates the position of the wheels 31 of the first pair 32 relative to one another. It will be appreciated that the wheels 31 of the second pair 33 are mounted to the opposing second end 86 of the frame 82 in exactly the same manner. The flange 96 of each wheel of the first pair 32 is mounted to the first end 84 of the frame so that the wheels of the first pair are displaced in circumferential direction of the outer surface 34 of the pipe 12 through an angle $\alpha$. More specifically, the wheels of the first pair must be oriented to one another at an angle $\alpha$ so that the wheels maintain their frictional engagement with the outer surface of the pipe as the pipe is rotated. Preferably, the wheels of the first pair are oriented at a 60° angle to one another in order to maintain stability of the wheels as they follow their path along the pipe. By mounting the wheels of both the first pair 32 and the second pair 33 in the manner shown in FIG. 6, the frame 82 is properly supported on the pipe between the frame's first end 84 and its second end 86. This construction also stabilizes the carrier 30 as it moves along the pipe.

Figure 7:
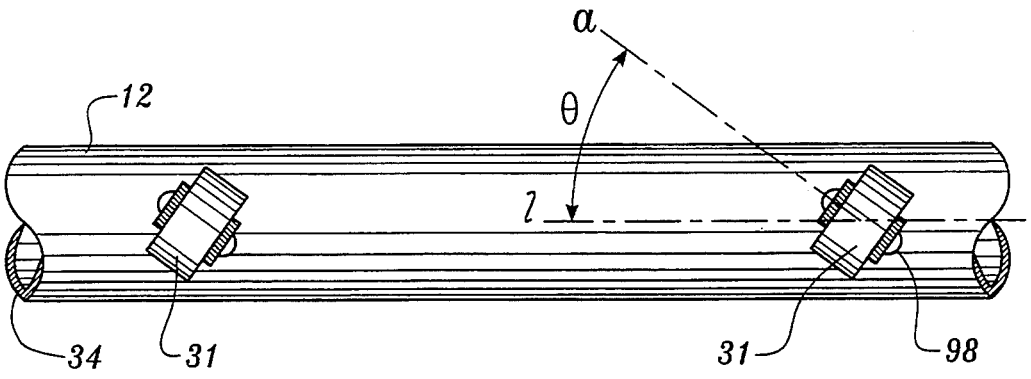
FIG. 7 is a cross-sectional view of the carrier and support pipe along the Line F—F of FIG. 6.

In addition to being oriented at a 60° angle to one another, the wheels 32 of both pairs in the preferred embodiment are oriented at the same "pitch" with respect to the longitudinal axis l of the pipe 12 as illustrated in FIG. 7. FIG. 7 is a cross-sectional view of the carrier along the Line F—F of FIG. 6. If an axis a is drawn through an axle 98 of the wheel 31, this axis a would be inclined through an acute angle Θ with respect to the longitudinal axis l of the pipe. This angle Θ is known as the "pitch." The axles of all four wheels of the carriage 30 should be inclined at the same acute angle Θ with respect to the longitudinal axis of the pipe. Hence, the carrier 30, together with the carriage 28, is propelled along the longitudinal axis l of the support pipe at a rate of $\pi dn$ (Θ) inches per second; where d is a diameter of the support pipe in inches, n is a number of revolutions of the pipe per second, and Θ is a pitch of the wheels relative to the longitudinal axis of the pipe. It is obvious that if the number of rotations per second is increased or if the pitch is increased, the speed of the movement of the carriage 28 in the longitudinal direction of the pipe will likewise be increased. It will also be obvious that if the direction of rotation of the pipe is reversed, the direction of movement of the carriage along the pipe will also be reversed because both the wheels 31 of the first pair 32 and the second pair 33 are oriented at the same pitch. It is also obvious that regardless of the direction of rotation of the pipe, the wheels of both the first pair 32 and the second pair 33 will follow a helical, thread-like path along the pipe as the pipe is rotated.

Figure 5:
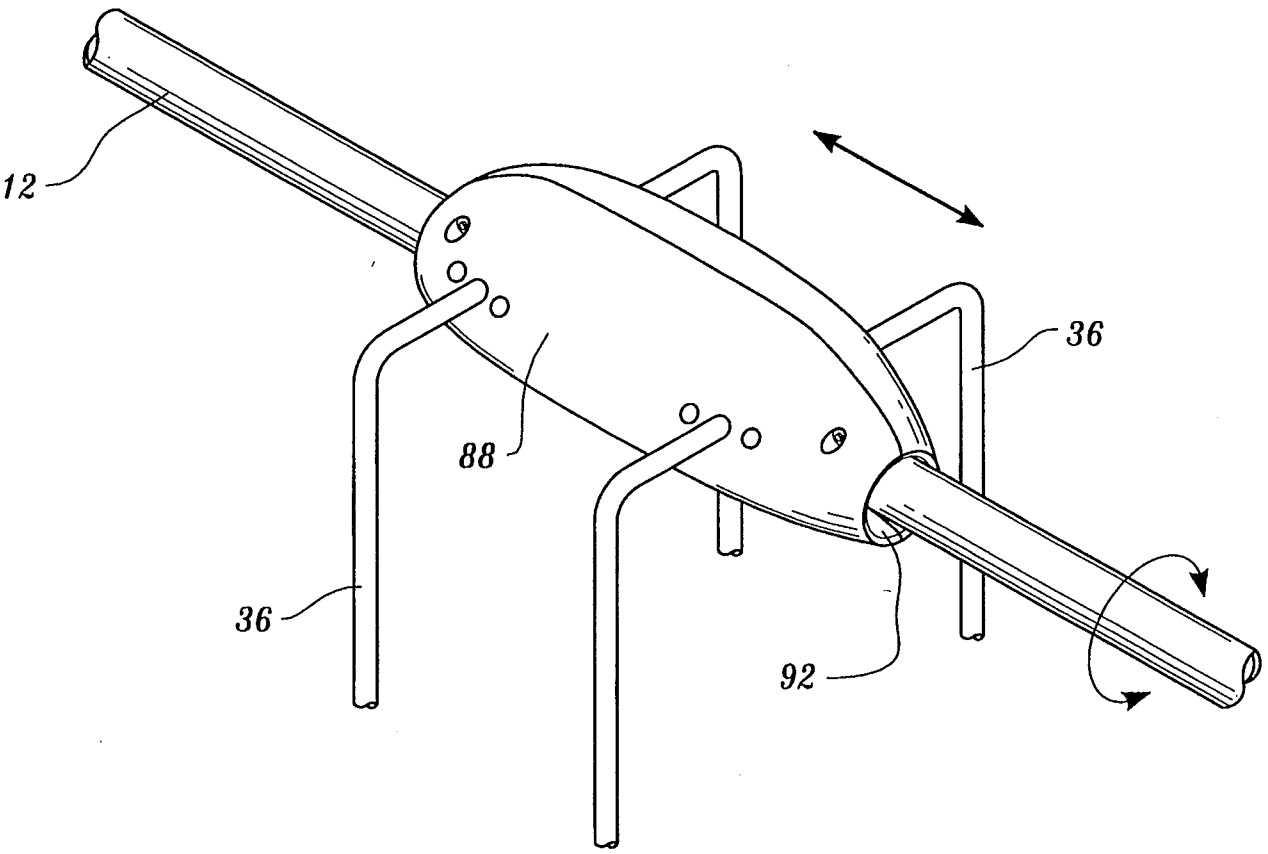
FIG. 5 is a three-dimensional view of the structure illustrated in FIG. 4 once assembled.

Referring to FIGS. 1, 4 and 5, the carriage 28 further comprises a plurality of handrails 36 which extend downwardly from the carrier 30 and are attached to a platform 37 so that the platform is suspended below the carrier. The handrails and the platform are designed to support a number of persons mounted upon the carriage 30. In addition, the carrier 30 including the frame 82 and the wheels 31 is encapsulated by a protective housing 88. The housing 88 is preferably made of a strong resilient material such as plastic that can withstand exposure to the natural elements of the outdoors and the constant use by people. The housing encapsulates the carrier 30 so as to protect persons from accessing the carrier's frame 82 and wheels 31 and injuring themselves. In addition, the housing provides a person with a saddle so that he or she can ride on top of the carriage 28. The housing comprises two halves 88*a* and 88*b* which are bolted together around the carriage 30 and the pipe 12 by a bolt 94. The housing contains a number of small bores 90 through which the handrails 36 may pass so that a plate 27 attached to the upper end of each handrail may be bolted upon the frame 82 of the carrier 30. In addition, the housing, when joined, forms a circular opening 92 on either end that allows the pipe 12 to pass through the housing. A large protective ring 89 is mounted adjacent to the large circular openings 92 on either end of the housing so that the ring surrounds the pipe as it passes through the housing. The large protective ring is preferably made of an ultra-high molecular weight plastic or similar anti-friction material so that the plastic housing freely slides along the support pipe as the carriage 28 moves along the pipe. In addition, the protective ring 89 prevents persons from reaching into the housing and injuring themselves. Consequently, a person can safely climb upon the housing without fear of injury. It will be readily apparent to those skilled in the art that the housing may be of any configuration suitable to prevent persons from accessing the carrier 30 or to facilitate a person's use of the carriage 28.

Figure 8:
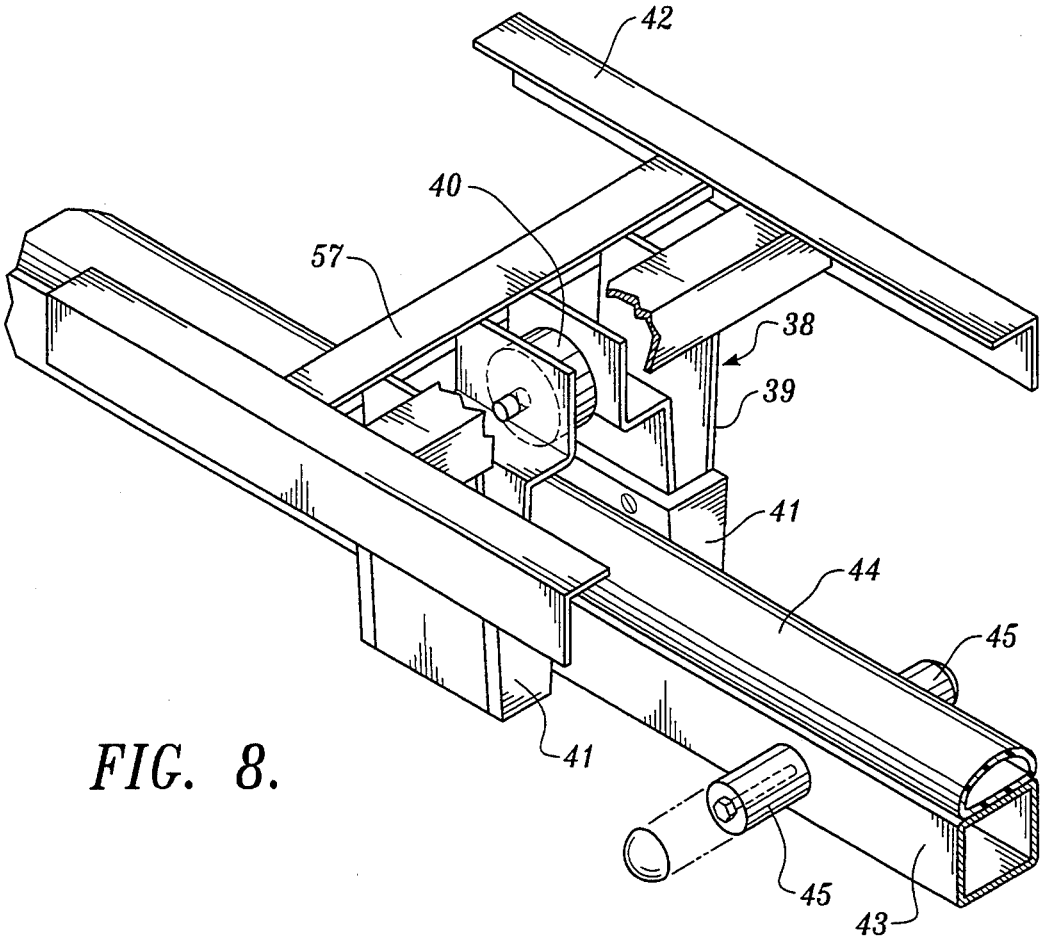
FIG. 8 is a top view of a guide attached to a platform in accordance with the present invention.
Figure 9:
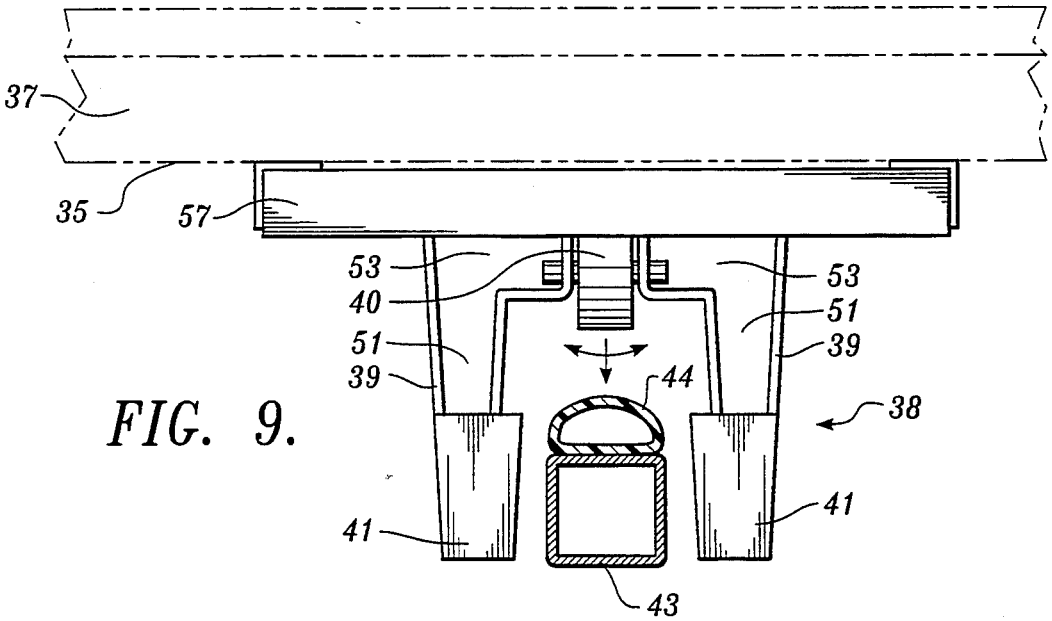
FIG. 9 is a front view of the guide attached to the platform of FIG. 8.

Referring to FIGS. 8 and 9, the playground carriage 10 further comprises a guide rail 43 adapted to guide the carriage 28 as it moves along the pipe 12. The guide rail is located immediately below the platform 37 of the carriage 28 and extends between the first vertical column 18 and the second vertical column 20. A bumper 44 is attached to the upper surface of the guide rail 43. The bumper protects users from striking the guide rail and injuring themselves. The bumper is preferably made of a flexible and resilient material such as rubber or plastic.

To further increase the stability of the carriage, a guide 38 is attached to a lower surface 35 of the platform 37. The guide 38 engages the guide rail 43 and prevents the carriage 30 from swinging excessively from side-to-side as the carriage moves along the pipe 12. The guide comprises a pair of substantially L-shaped flanges 39 coupled to a substantially H-shaped frame 42. The H-shaped frame is mounted to the lower surface of the platform directly above the guide rail. The flanges and the H-shaped frame are preferably made of a very strong rigid material such as galvanized steel. Each flange 39 includes a substantially vertical leg 51 and a substantially horizontal base 53. The base 53 of each flange is coupled to a cross-bar 57 of the H-shaped frame so that the flanges oppose each other and the legs 51 extend downwardly from the lower surface of the platform. In addition, the flanges are mounted to the underside of the cross-bar 57 a small distance apart, leaving a gap between the bases. A wheel 40 is housed within the gap between the bases and is supported by the respective bases. The wheel 40 is preferably made of urethane plastic or similar friction-reducing, durable material. Finally, the guide 38 comprises an anti-friction sleeve 41 which covers the lower portion of the leg 51 of each flange. The anti-friction sleeve is preferably made of an ultra-high molecular weight plastic or similar anti-friction material.

In operation, the guide rail 43 passes between the flanges 39 of the guide 38. If the carriage 28 begins to swing transversely relative to the pipe 12, the flange will make contact with the guide rail and prevent the carriage from swinging any farther. However, the longitudinal progress of the carriage will not be stopped because the anti-friction sleeve 41 will allow the flange to slide along the guide rail. Hence, the friction caused by the flange striking the guide rail will prevent the carriage from swinging transversely to a great degree, but will not prevent the carriage from continuing its movement longitudinally along the pipe.

Another potential impediment to the longitudinal progress of the carriage is overloading the carriage with an abnormally large group of people so that the carriage bumps along the guide rail as the carriage moves along the pipe 12. When this occurs, the wheel 41 is forced into contact with the bumper 44 momentarily. The carriage continues its longitudinal progress, however, because the wheel 41 rolls on top of the bumper and along the guide rail. The bumper will give slightly beneath the wheel due to the weight of the carriage. To support the guide rail as the carriage bumps and swings against the guide rail, a vertical support post 15 is mounted to the underside of the guide rail at either end of the guide rail.

In addition to the bumper 44 and the support posts 15, a stop 45 is attached to the guide rail 43 adjacent to the first vertical column 18, and adjacent to the second vertical column 20. The stop protrudes from both sides of the guide rail. As the carriage 28 reaches the first or second vertical column, the guide 38 will come into contact with the stop 45, forcing the carriage to a halt. Hence, the carriage will not ram into the first or second vertical column and cause injury to the user or damage to the carriage. It will be obvious to one skilled in the art that stops of various configurations could adequately serve this purpose.

Finally, referring to FIG. 1 a preferred embodiment of a playground carriage 10 further includes a receiving deck 50 located adjacent to the second vertical column 20. Therefore, those persons transported by the carrier 28 may dismount the carrier and step directly upon the receiving deck 50. In addition, the preferred embodiment of the playground carriage 10 includes a cranking deck 52 located adjacent to the first vertical column 18, so that the person manually turning the crank 22 may stand upon the cranking deck 52. It will be readily apparent to those skilled in the art that any structures providing an area upon which persons may dismount or stand, may suitably be used.

While a number of the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for use in playground and recreational environments adapted to move from one area to another:

(a) a support pipe rotatable along its longitudinal axis, the pipe having a smooth cylindrical outer surface, a first end of the support pipe braced by a first vertical column, a second end of the support pipe braced by a second vertical column, wherein the support pipe extends between the first vertical column and the second vertical column;

(b) a manually-operated crank having a first end and a second end, wherein the first end of the crank is coupled to the first end of the support pipe so that manually turning the crank rotates the pipe; and (c) a carriage mounted upon the support pipe for moving objects along the longitudinal axis of the support pipe, the carriage comprising;

(1) a carrier adapted to advance the carriage along the pipe, wherein the carrier contains a set of wheels oriented along the outer surface of the pipe so that the set of wheels follows a helical, thread-like path along the pipe and propels the carriage along the longitudinal axis of the pipe as the pipe is rotated;

(2) a handrail extending downwardly from the carrier;

(3) a platform attached to the handrail so that the platform is suspended below the carrier; and (4) a protective housing encapsulating the carrier.

2. The apparatus of claim 1, wherein the carrier further comprises a substantially rectangular frame having a first end and an opposing second end, wherein the frame is placed about the pipe so that the frame is parallel to the pipe.

3. The apparatus of claim 2, wherein the set of wheels comprises a first pair of wheels attached to the first end of the frame and a second pair of wheels attached to the second end of the frame so that both the first pair and the second pair of wheels frictionally engage the outer surface of the pipe.

4. The apparatus of claim 3, wherein the wheels of the first pair are oriented at a predetermined angle to one another, and wherein the wheels of the second pair are oriented at a predetermined angle to one another.

5. The apparatus of claim 4, wherein the wheels of both the first pair and the second pair are oriented at the same pitch relative to the longitudinal axis of the pipe, so that the wheels of both the first pair and the second pair follow a helical, thread-like path along the pipe as the pipe is rotated.

6. The apparatus of claim 1, further comprising a guide rail adapted to guide the carriage, wherein the guide rail is located immediately below the platform of the carriage and extends parallel to the support pipe between the first vertical column and the second vertical column.

7. The apparatus of claim, wherein the carriage further comprises a guide attached to a lower surface of the platform, wherein the guide engages the guide rail and prevents the carriage from swinging excessively as it moves along the pipe.

8. The apparatus of claim 7, wherein the guide houses a wheel that rolls along the guide rail when the carriage is occasionally forced into contact with the guide rail.

9. The apparatus of claim 6, wherein the guide rail further comprises a stop located adjacent to the first vertical column, and a stop located adjacent to the second vertical column.

10. The apparatus of claim 1, further comprising a plurality of handrails extending downwardly from the carriage.

11. The apparatus of claim 10, wherein the protective housing includes a plurality of bores through which the pipe and the handrails pass.

12. The apparatus of claim 1, further comprising a third vertical column, wherein the second end of the crank is attached to the third vertical column, so that the crank extends between the first vertical column and the third vertical column.

13. The apparatus of claim 12, wherein the second end of the manually-operated crank is coupled to a bearing mounted on the third vertical column, and wherein the bearing supports the crank and allows the crank to be turned freely.

14. The apparatus of claim 1, wherein the first end of the support pipe is coupled to a bearing mounted on the first vertical column, wherein the second end of the support pipe is coupled to a bearing mounted on the second vertical column, and wherein the bearings support the pipe and allow the pipe to rotate freely.

15. The apparatus of claim 14, wherein the first end of the manually-operated crank is coupled to a protective ring mounted adjacent to the first vertical column.

16. The apparatus of claim 1, further comprising a receiving deck adjacent to the second vertical column and upon which people transported by the carriage may dismount.

17. The apparatus of claim 1, further comprising a cranking deck adjacent to the first vertical column and upon which people manually turning the crank may be positioned.

18. An apparatus for use in playground and recreational environments, adapted to move along a path, comprising:

(a) a rotatable support pipe having a smooth cylindrical outer surface, a first end of the support pipe attached to a first vertical column, a second end of the support pipe attached to a second vertical column, wherein the support pipe extends longitudinally between the first and second vertical columns;

(b) a cranking means coupled to the first end of the support pipe by a joint that extends through the first vertical column, wherein the support pipe is rotated by manually turning the cranking means;

(c) a carrying means mounted to the support pipe for moving objects along the support pipe as the pipe is rotated, wherein the carrying means comprises a carrier adapted to advance the carrying means along the pipe, a handrail extending downwardly from the carrying means, a platform attached to the handrail so that the platform is suspended below the carrying means, and a protective housing that encapsulates the carrier; and (d) a guiding means for preventing the carrying means from swinging excessively as the carrying means moves along the pipe as the pipe is rotated, wherein the guiding means includes a guide attached to a lower surface of the platform, and wherein the guide engages a guide rail that is located below the carrying means and that extends parallel to the pipe between the first vertical column and the second vertical column.

19. The apparatus of claim 18, wherein the carrier is advanced along the support pipe by a set of wheels mounted beneath the carrier and adjacent to the pipe, wherein the set of wheels is oriented along the outer surface of the pipe so that the wheels frictionally engage the outer surface of the pipe and follow a helical, thread-like path along the path, thus propelling the carrying means along the pipe as the pipe is rotated.

20. The apparatus of claim 19, wherein the set of wheels includes a first pair of wheels and a second pair of wheels mounted at opposite ends of the carrier.

21. The apparatus of claim 20, wherein the wheels of the first pair are oriented at a predetermined angle to one another, and wherein the wheels of the second pair are oriented at a predetermined angle to one another.

22. The apparatus of claim 21, wherein the wheels of both the first pair and the second pair are oriented at the same pitch relative to the longitudinal axis of the pipe, so that the wheels of both the first pair and the second pair follow a helical, thread-like path along the pipe as the pipe is rotated.

23. The apparatus of claim 18, further comprising a plurality of handrails extending downwardly form the carriage.

24. The apparatus of claim 23, wherein the cranking means extends between a protective ring mounted on the first vertical column and a bearing mounted on the third vertical column, and wherein the bearing supports the pipe and allows the cranking means to be turned freely.

25. The apparatus of claim 18, wherein the guiding means further comprises a wheel housed within the guide that rolls along the guide rail when the carriage is occasionally forced downwardly against the guide rail.

26. The apparatus of claim 18, wherein the guide rail further comprises a stop located adjacent to the first vertical column, and a stop located adjacent to the second vertical column.

27. The apparatus of claim 18, wherein the protective housing includes a plurality of bores through with the pipe and handrails pass.

28. The apparatus of claim 18, further comprising a third vertical column, wherein the cranking means extends between the first vertical column and the third vertical column.

29. The apparatus of claim 18, further comprising a receiving deck adjacent to the vertical column and upon which people transported by the carrying means may dismount.

30. The apparatus of claim 18, further comprising a cranking deck adjacent to the first vertical column and upon which people manually turning the cranking means may be positioned.

31. The apparatus of claim 18, wherein the first end and the second end of the support pipe are coupled to a bearing mounted on the first vertical column and the second vertical column, respectively, and wherein the bearings support the pipe and allow the pipe to rotate freely.

* * * * *

UNITED STATES PATENT AND TRADEMARK OFFICE

CERTIFICATE OF CORRECTION

PATENT NO. : 5,443,012

DATED : August 22, 1995

INVENTOR(S) : J.M. Underbrink et al.

It is certified that error appears in the above-indentified patent and that said Letters Patent is hereby corrected as shown below:

| COLUMN | LINE | |
|---|---|---|
| 10 (Claim 7, | 15 line 1) | "claim," should read --Claim 6,-- |
| 12 (Claim 23, | 5 line 2) | "form" should read --from-- |

Signed and Sealed this

Twenty-eighth Day of November 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,443,012

DATED : August 22, 1995

INVENTOR(S) : J.M. Underbrink et al.

It is certified that error appears in the above-indentified patent and that said Letters Patent is hereby corrected as shown below:

| COLUMN | LINE | |
|---|---|---|
| 9 | 28 | "another:" should read --another, comprising:-- |

Signed and Sealed this

Twenty-seventh Day of February, 1996

*Attest:*

Bruce Lehman

BRUCE LEHMAN

*Attesting Officer*

*Commissioner of Patents and Trademarks*